US010099352B2

(12) United States Patent
Hohmann et al.

(10) Patent No.: US 10,099,352 B2
(45) Date of Patent: Oct. 16, 2018

(54) TORQUE WRENCH SYSTEM

(71) Applicants: Jorg Hohmann, Meschede (DE); Frank Hohmann, Warstein (DE)

(72) Inventors: Jorg Hohmann, Meschede (DE); Frank Hohmann, Warstein (DE)

( * ) Notice: Subject to any disclaimer, the term of this patent is extended or adjusted under 35 U.S.C. 154(b) by 228 days.

(21) Appl. No.: 15/159,992

(22) Filed: May 20, 2016

(65) Prior Publication Data

US 2016/0339569 A1 Nov. 24, 2016

(30) Foreign Application Priority Data

May 20, 2015 (DE) ..... 10 2015 006 564

(51) Int. Cl.
*B25B 21/00* (2006.01)
*B25F 3/00* (2006.01)
*B25B 23/00* (2006.01)

(52) U.S. Cl.
CPC ..... *B25B 21/005* (2013.01); *B25B 23/0007* (2013.01); *B25F 3/00* (2013.01)

(58) Field of Classification Search
CPC . B25B 21/005; B25B 23/0007; B25B 21/004; B25B 23/00078; B25B 13/463; B25B 21/002; B25F 3/00
See application file for complete search history.

(56) References Cited

U.S. PATENT DOCUMENTS 6,330,842 B1 12/2001 Brun
2002/0121161 A1 9/2002 Koppenhoefer
(Continued)

FOREIGN PATENT DOCUMENTS

CN 203726402 7/2014
DE 29516060 U1 12/1995
(Continued)

OTHER PUBLICATIONS

German Office Action; German Application Serial No. 102015006564.5; dated Feb. 23, 2016; 10 pages.
(Continued)

*Primary Examiner* — Robert Scruggs
(74) *Attorney, Agent, or Firm* — John H. Thomas, P.C.

(57) ABSTRACT

In a torque wrench system with a drive unit (2) and a ratchet unit (3), which can releasably be assembled to a wrench unit, wherein drive unit (2) and ratchet unit (3) releasably are rigidly connected with each other in the assembled condition, the drive unit (2) includes a first drive coupling element (5) and the ratchet unit (3) includes a ratchet (18) and a second drive coupling element which is in driving engagement with the ratchet (18) and, in the assembled condition of drive unit (2) and ratchet unit (3), also with the first drive coupling element (5) for driving the ratchet (18), the drive unit (2) includes at least one latch (7) which is movable from an unlocking position, in which the drive unit (2) and the ratchet unit (3) are releasable from each other, into a locking position, in which the drive unit (2) and the ratchet unit (3) are rigidly connected with each other in the assembled condition, and back, and at least one actuating element (9) with which the at least one latch (7) is movable from the one into the other position, and the ratchet unit (3) includes a latch receptacle (23) which is in locking engagement with the latch (7) in its locking position for rigidly connecting the drive unit (2) with the ratchet unit (3) in their assembled condition.

7 Claims, 3 Drawing Sheets

(56) References Cited

U.S. PATENT DOCUMENTS

| | | | | |
|---|---|---|---|---|
| 2012/0024556 | A1 | 2/2012 | Zhu | |
| 2014/0238203 | A1 * | 8/2014 | Spirer | B25B 23/0007 81/57.39 |

FOREIGN PATENT DOCUMENTS

| | | | |
|---|---|---|---|
| DE | 10236586 | A1 | 2/2004 |
| DE | 60126408 | T2 | 8/2007 |
| JP | S5622777 | | 2/1981 |
| JP | H3117567 | | 5/1991 |

OTHER PUBLICATIONS

Europe Application Serial No. EP 16001054; Search Report dated Oct. 13, 2016; 2 pages.
Japan Patent Application Serial No. 2016-100378; Office Action; dated Jun. 27, 2017; 2 pages.

* cited by examiner

TORQUE WRENCH SYSTEM

CROSS-REFERENCE TO RELATED APPLICATIONS

This is a United States Patent claiming priority from German Patent Application No. 10 2015 006 564.5 having a filing date of May 20, 2015, the contents of which are incorporated herein by reference.

This invention relates to a torque wrench system with a drive unit and a ratchet unit, which can releasably be assembled to a wrench unit, wherein drive unit and ratchet unit releasably are rigidly connected with each other in the assembled condition, the drive unit includes a first drive coupling element and the ratchet unit includes a ratchet and a second drive coupling element which is in driving engagement with the ratchet and, in the assembled condition of drive unit and ratchet unit, also with the first drive coupling element for driving the ratchet.

Such torque wrench system is known from US 2014/0238203 A1. Drive unit and ratchet unit are releasably connected with each other, as a ratchet unit is designed for tightening one nut size only. To be able to tighten different nut sizes with one and the same drive unit, the ratchet unit can be exchanged for adaptation to the respective nut size. For connecting the drive unit with the ratchet unit, the ratchet unit includes two connecting arms which in the assembled condition of drive unit and ratchet unit are pressed into openings in the drive unit by spring force. In its rear end region in output direction, the ratchet unit furthermore includes a bolt extending transversely to the output direction, which in the assembled condition of drive unit and ratchet unit is enclosed by a semicircular recess in the drive unit. In the assembled condition, drive unit and ratchet unit thus releasably are rigidly connected with each other. With the assembly of drive unit and ratchet unit, the drive coupling element present in the drive unit is brought into driving engagement with the drive coupling element present in the ratchet unit, so that by means of the drive coupling elements of drive unit and ratchet unit the ratchet can be driven. The drive coupling element and the semicircular recess of the drive unit lie on the center line of the drive unit, and the center line of the drive unit extends through the bolt of the ratchet unit. To release drive unit and ratchet unit from each other, the connecting arms can be moved out of the openings in the drive unit against the spring force by means of a handle at the ratchet unit, whereby the ratchet unit can be removed and be replaced by another one.

What is disadvantageous in this known torque wrench system is its handling when the drive unit is to be released from the ratchet unit. The drive unit must be grasped with one hand, while the connecting elements at the ratchet unit must be moved back against the spring force with the other hand. As a result, the replacement of ratchet units requires relatively much time, in particular when e.g. in cramped conditions the room for movement of the assembler for removing the drive unit is constrained. In addition, there are screwing operations in which after screwing it is desirable for weight reasons—screws up to a size M100 are employed—to separate the drive unit from the ratchet unit, but in which the required accessibility of the ratchet unit is not given to the required extent.

It therefore is the object underlying the invention to improve a generic torque wrench system such that the drive unit can be released from the ratchet unit more easily and quickly.

According to the invention, this is achieved in a torque wrench system as mentioned above in that the drive unit includes at least one latch which is movable from an unlocking position, in which the drive unit and the ratchet unit are releasable from each other, into a locking position in which the drive unit and the ratchet unit are rigidly connected with each other in the assembled condition, and back, and at least one actuating element with which the at least one latch is movable from the one into the other position, and the ratchet unit includes a latch receptacle which is in locking engagement with the latch in its locking position for rigidly connecting the drive unit with the ratchet unit in their assembled condition.

Due to the measures according to the invention, the drive unit and the ratchet unit can be released from each other very quickly and easily. Due to the fact that the drive unit includes at least one latch, which is movable from an unlocking position into a locking position and back, and at least one actuating element with which the latch is movable from the one into the other position, wherein the ratchet unit includes a latch receptacle with which the latch is in locking engagement in its locking position in the assembled condition of drive unit and ratchet unit, it is possible with one hand only to both hold the drive unit and actuate the latch for unlocking by means of the actuating element, and to subsequently remove the drive unit. Due to this handling of the torque wrench system according to the invention with one hand only, a fast and comfortable separation of drive unit and ratchet unit is possible, and this in particular also at places difficult to access and/or in confined spaces, such as when fitting screws in internal corners or in overhead positions or in partly concealed positions or in positions which are distinctly away from the body of the assembler and in which the same therefore must stretch his arms away from the body for actuating the torque wrench system. Due to the measures according to the invention the drive unit also can be released from the ratchet unit with the hand which anyway is needed for grasping the drive unit, and the other hand is free—e.g. for protective measures. In those cases in which the ratchet unit still must be retained for other reasons on separation from the drive unit, retaining the ratchet unit can be effected under purely ergonomic aspects, without any constraints due to the releasing operation.

In a preferred embodiment of the invention the drive unit includes a front boundary surface in output direction and the ratchet unit includes a seat for accommodating the drive unit, which has an end face against which the drive unit rests with its front boundary surface in the assembled condition of drive unit and ratchet unit, and in the locking position the at least one latch protrudes from the front boundary surface of the drive unit and the latch receptacle is a depression in the seat end face of the ratchet unit. With these measures the assembly of drive unit and ratchet unit is facilitated, as the seat of the ratchet unit forms a guide for the drive unit, whereby the front boundary surface of the drive unit and hence the latch is guided to the latch receptacle in the ratchet unit.

Preferably, the at least one latch is retractable in the unlocking position to such an extent that it maximally extends up to the front boundary surface of the drive unit. In this way, the drive unit can easily be separated from the ratchet unit, in that the drive unit is lifted or pushed out of the seat of the ratchet unit along the front boundary surface.

Preferably, each latch is spring-biased into its locking position and by means of the latch actuating element movable from the locking position into its unlocking position against the spring bias. During the assembly of drive unit and ratchet unit the latches thereby automatically take their locking position due to the spring bias, so that the latches need not be actuated manually during assembly.

Advantageously, the first drive coupling element protrudes from the front boundary surface of the drive unit and can be brought into driving engagement with the second drive coupling element through an opening in the seat end face of the ratchet unit. The seat of the ratchet unit hence also serves as guide by means of which the drive coupling element of the drive unit is guided to the drive coupling element of the ratchet unit and is brought into driving engagement with the same. As both the first drive coupling element and the latches protrude from the front boundary surface of the drive unit and the second drive coupling element and the latch receptacles are arranged in the seat end face or can be reached through the same, it is ensured that both the drive coupling elements and the latches and latch receptacles jointly are brought in engagement, when the front boundary surface of the drive unit rests against the seat end face of the ratchet unit.

Preferably, on both sides of the first drive coupling element a latch each is arranged, and on both sides of the second drive coupling element associated latch receptacles each are arranged. During operation, a bending load of the drive coupling elements parallel to a straight connecting line through the latches hence largely is excluded. In the case of a symmetrical arrangement of the latches relative to the first drive coupling element and a corresponding symmetrical arrangement of the associated latch receptacles relative to the second drive coupling element, a bending load completely is excluded.

In a favorable development of the invention the drive unit includes a second boundary surface and the ratchet unit includes a base surface in its seat for the drive unit, which surfaces both extend along the output direction and in the assembled condition of drive unit and ratchet unit rest against each other, and the drive unit includes a supporting wedge on its second boundary surface, which extends along the output direction and whose wedge angle opens to the rear vertically to the second boundary surface against the output direction, and the ratchet unit includes a corresponding depression for accommodating the supporting wedge in its seat base surface, wherein on its back the supporting wedge includes a supporting surface and the depression includes an abutment surface at its rear end, against which the supporting surface of the supporting wedge rests in the assembled condition of drive unit and ratchet unit. In the assembled—i.e. locked—condition of drive unit and ratchet unit, the drive unit can forward laterally and rearwardly directed compressive forces to the ratchet unit via the supporting wedge, without components of the drive unit or the ratchet unit being subjected to a bending load. The admissible loads or the transmittable forces thereby are increased substantially. In addition, the risk of deformations occurring in operation is reduced distinctly, as the bending deformations occurring already at relatively low bending loads are avoided. The design freedom also is substantially increased thereby. Constructional constraints, such as the requirement that both the drive coupling elements of drive unit and ratchet unit and the rear supporting structure between drive unit and ratchet unit must lie on the center line of the drive unit—as requested in the prior art—no longer do exist.

At least one protrusion extending to the rear protrudes from the supporting surface of the supporting wedge, and in the abutment surface of the depression a recess is formed, which in the assembled condition of drive unit and ratchet unit accommodates the at least one protrusion of the supporting wedge, wherein the outer wall of the protrusion rests against the inner wall of the recess. With these measures, rotating the drive unit to the top out of the depression is prevented.

The invention will subsequently be explained in greater detail by way of example with reference to the drawings, in which.

Figure 1:
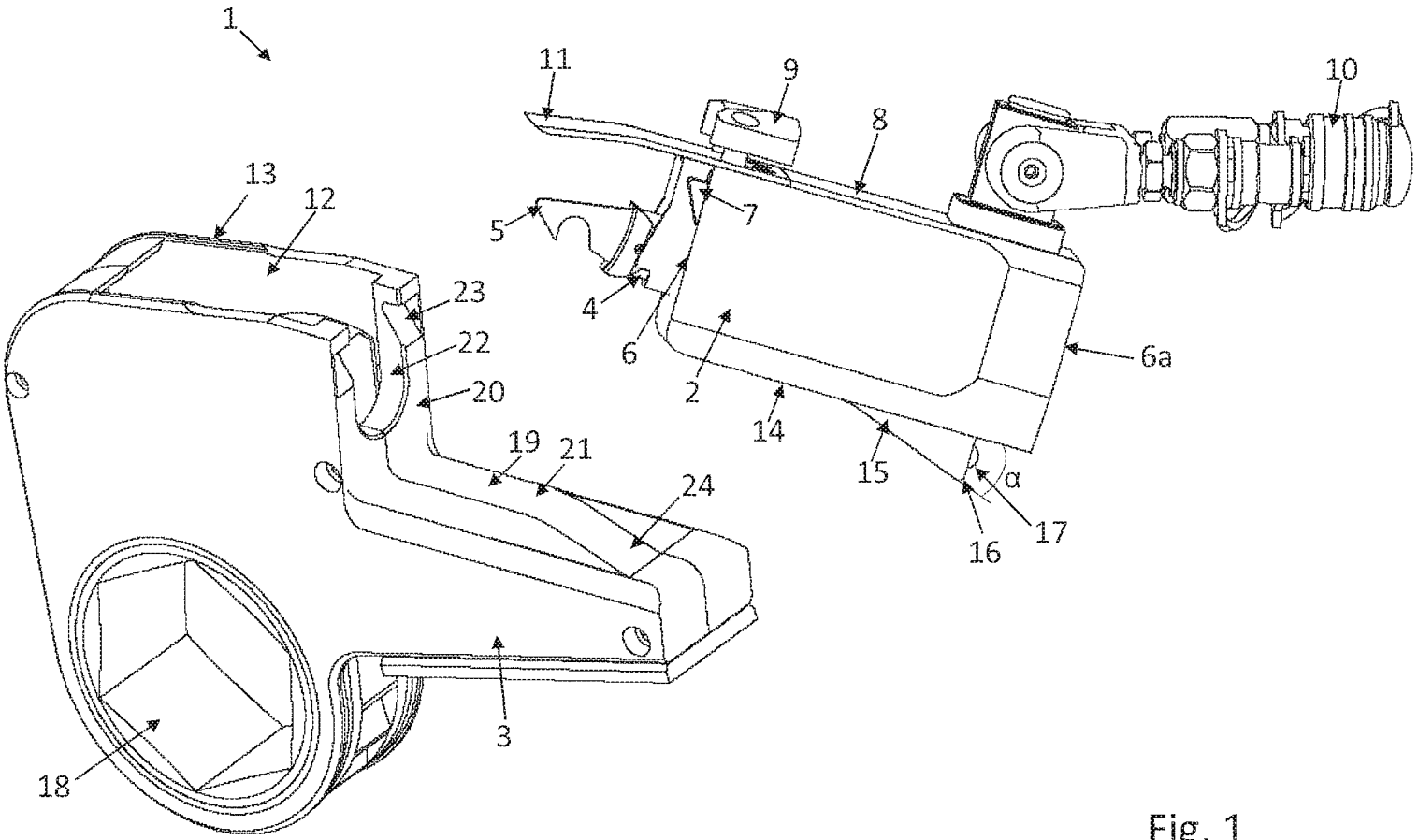
FIG. 1 shows a perspective view of an embodiment of a torque wrench system according to the invention, wherein drive unit and ratchet unit are released from each other.

The exemplary embodiment of a torque wrench system 1 according to the invention as shown in FIGS. 1 to 5 includes a drive unit 2 and a ratchet unit 3, which can releasably be assembled to a wrench unit and in the assembled condition releasably are rigidly connected with each other.

The drive unit 2 includes a drive cylinder 4 and the same includes a first drive coupling element 5 on its output side. The drive cylinder 4 and the first drive coupling element 5 protrude from a front boundary surface 6 of the drive unit 2 as seen in output direction. Its rear boundary surface 6*a* in part is formed by the lid 4*a* of the drive cylinder 4.

To the left and right of the drive cylinder 4 and the first drive coupling element 5 two latches 7 protrude from the front boundary surface 6. The latches 7 are spring-biased into this protruding position, which is the locking position.

On the upper side 8 of the drive unit 2 as shown in the Figures, an actuating element 9 in the form of an actuating lever is mounted, with which the two latches 7 are movable from the locking position against the spring bias back into an unlocking position, in which they extend within the drive unit 2 maximally up to its front boundary surface 6.

In the illustrated exemplary embodiment the drive unit 2 is a hydraulic drive unit. The hydraulic port 10 is formed on the upper side 8 of the drive unit 2.

In extension of the upper side 8 of the drive unit 2, a cover 11 extends in output direction, which in the assembled condition of drive unit 2 and ratchet unit 3 covers a part 12 of the upper side 13 of the ratchet unit 3.

On its lower side 14 as shown in the Figures, which subsequently is referred to as second boundary surface, the drive unit 2 includes a supporting wedge 15 which extends along the output direction with a wedge angle $\alpha$ which opens to the rear vertically to the second boundary surface 14 against the output direction. The size of the wedge angle $\alpha$ preferably lies in a range of 5° to 45°.

On its back 16, the supporting wedge 15 includes a protrusion 17 extending to the rear, which is formed to protrude into a corresponding recess (not shown) in the ratchet unit 3 with a precise fit, so that the outer wall of the protrusion 17 rests against the inner wall of the recess.

The ratchet unit 3 includes a ratchet 18 which is designed for abutment against the outer surfaces of a specified nut size. For each nut size a separate ratchet unit 3 therefore is provided.

The ratchet unit 3 includes a seat 19 for accommodating the drive unit 2. In the illustrated exemplary embodiment the seat 19 is formed L-shaped, wherein the short leg of the L forms a seat end face 20 and the long leg of the L forms a seat base surface 21.

In the seat end face 20 an opening 22 is formed, through which the first drive coupling element 5 of the drive unit 2 can be brought into driving engagement with a second drive coupling element (not shown) of the ratchet unit 3, when in the assembled condition of drive unit 2 and ratchet unit 3 the drive unit 2 rests against the seat end face 20 of the ratchet unit 3 with its front boundary surface 6.

The second drive coupling element also is in driving engagement with the ratchet 18, so that in the assembled condition of drive unit 2 and ratchet unit 3 the ratchet 18 of the ratchet unit 3 can be driven with the drive cylinder 4 of the drive unit 2 via the first and second drive coupling elements.

On both sides of the opening 22, through which the first drive coupling element 5 can be brought into driving engagement with the second drive coupling element, two depressions 23 are formed in the seat end face 20, which form latch receptacles and into which the two latches 7 arranged on the front boundary surface 6 of the drive unit 2 extend, when the drive unit 2 and the ratchet unit 3 are assembled, i.e. when the front boundary surface 6 of the drive unit 2 rests against the seat end face 20 of the ratchet unit 3.

In the seat base surface 21 a wedge-shaped depression 24 is formed, which is designed for accommodating the supporting wedge 15 of the drive unit 2. In the abutment surface (not shown) at the rear end of the depression 24 a recess is formed, which is designed for accommodating the protrusion 17 at the back 16 of the supporting wedge 15. In the assembled condition of drive unit 2 and ratchet unit 3, the outer wall of the protrusion 17 rests against the inner wall of the recess, so that compressive forces can be forwarded from the drive unit 2 into the ratchet unit 3.

Figure 3:
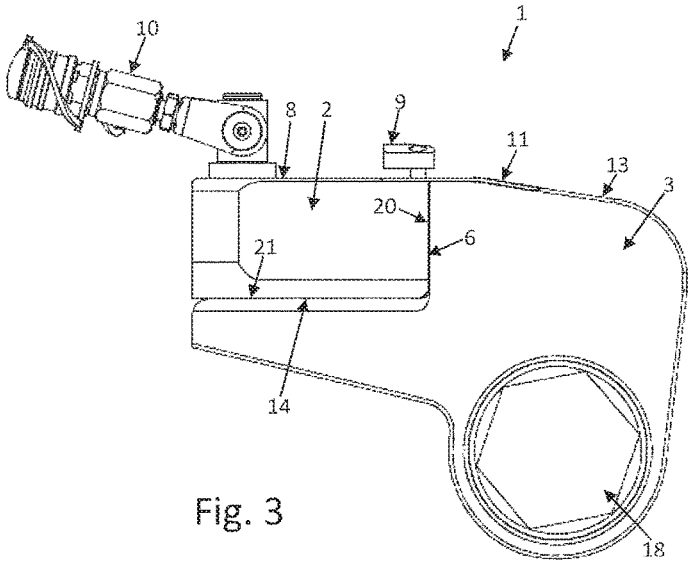
FIG. 3 shows a side view of the embodiment of FIG. 2.
Figure 4:
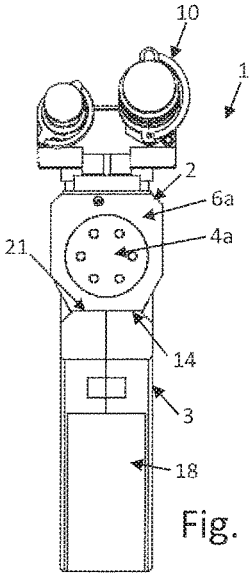
FIG. 4 shows a rear view of the embodiment of FIG. 2.
Figure 2:
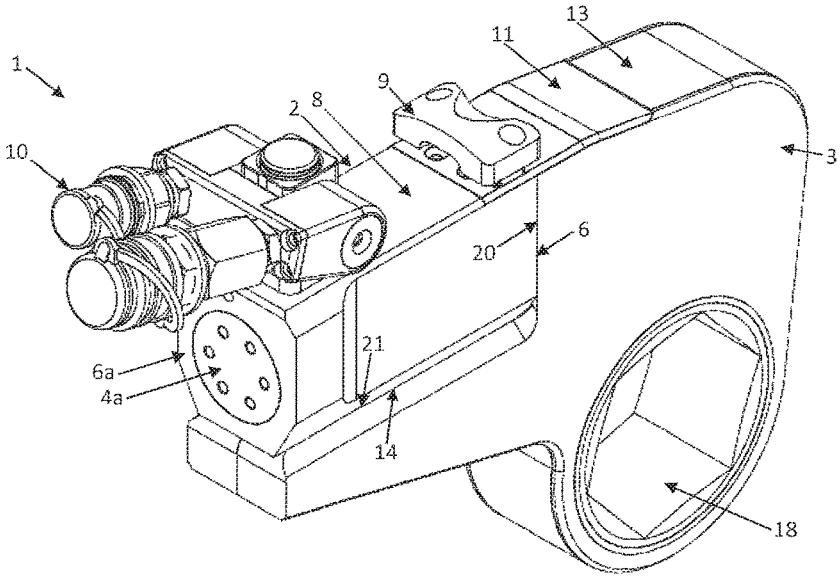
FIG. 2 shows a perspective view of the embodiment of FIG. 1, wherein drive unit and ratchet unit are assembled.
Figure 5:
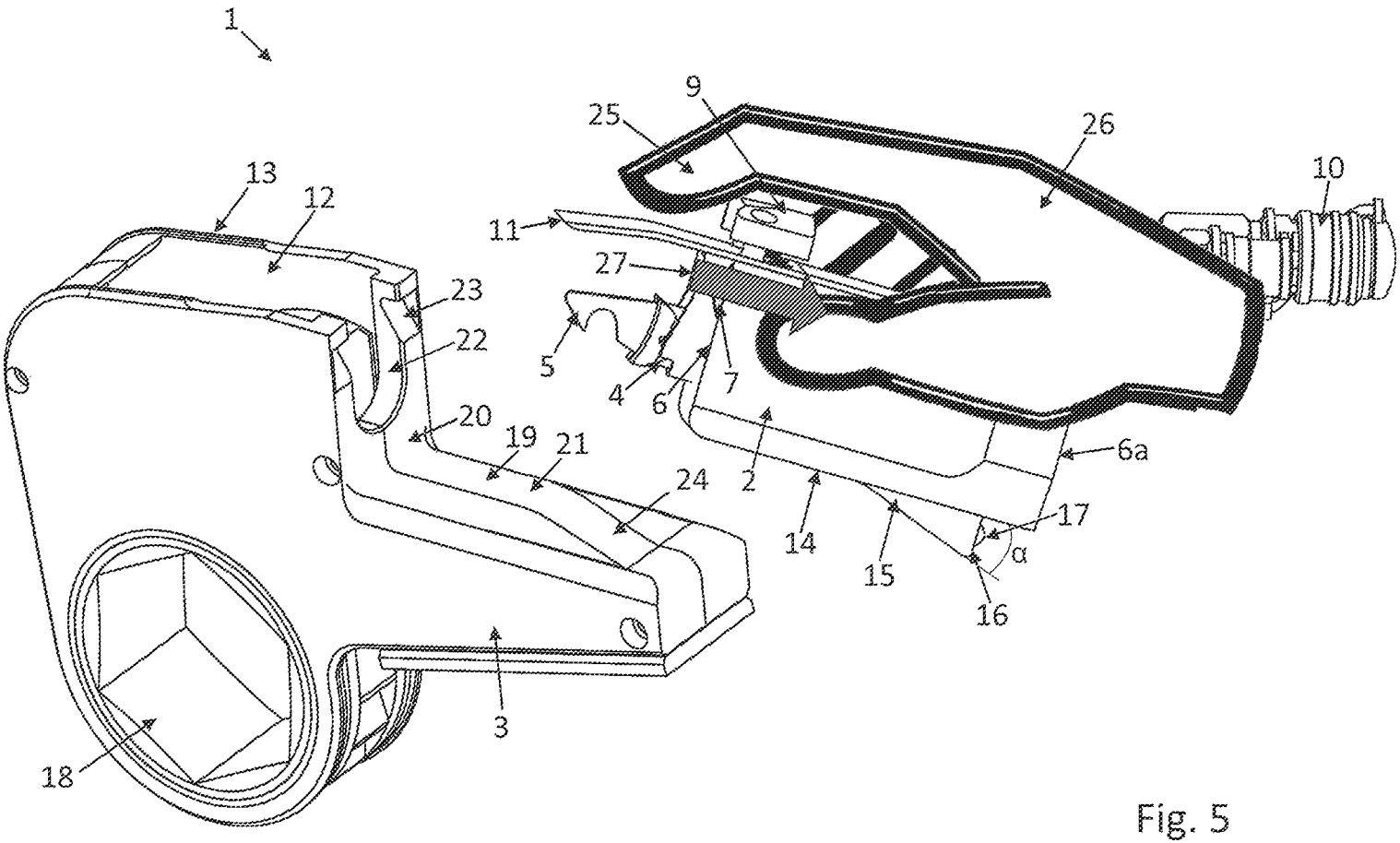
FIG. 5 shows a view similar to FIG. 1, with the representation of holding and releasing the drive unit with one hand.

For assembling drive unit 2 and ratchet unit 3, both are guided relative to each other such that the front boundary surface 6 of the drive unit 2 is guided towards the seat end face 20 of the ratchet unit 3 and the lower, second boundary surface 14 of the drive unit 2 is guided towards the seat base surface 21 of the ratchet unit 3 (FIG. 1). When the second boundary surface 6 is above the seat base surface 21, the protrusion 17 protruding from the back 16 or supporting surface of the supporting wedge 15 is introduced into the recess of the abutment surface at the rear end of the depression 24 in the seat base surface 21. The drive unit 2 with the protrusion 17 located in the recess then is rotated around the joint formed by both of them towards the ratchet unit 3, so that the front and the second boundary surface 6, 14 of the drive unit 2 come to rest against the seat end face 20 or the seat base surface 21 of the ratchet unit 3 and the first drive coupling element 5 thereby gets into driving engagement with the second drive coupling element through the opening 22 in the seat end face 20, and the two latches 7 of the drive unit 2 are pressed into the two associated latch receptacles 23 of the ratchet unit 3 by the spring bias and hence take their locking position in the latch receptacles 23 (FIGS. 2 to 4).

With the locking position of the latches 7 in the latch receptacles 23 and the abutment of the protrusion 17 against the back 16 of the supporting wedge 15 in the recess at the rear end of the depression 24 in the seat base surface 21, drive unit 2 and ratchet unit 3 are rigidly connected with each other in the assembled condition.

To release the drive unit 2 and the ratchet unit 3 from each other, the actuating lever 9 on the upper side 8 of the drive unit 2 can be actuated with one finger 25 of the hand 26 (FIG. 5), so that the latches 7 move back against their spring bias from their locking position into their unlocking position in which they are located within the drive unit 2. The drive unit 2 then can be removed from the ratchet unit 3, for example in direction of the arrow 27.

The invention claimed is:

1. A torque wrench system with a drive unit and a ratchet unit, which can releasably be assembled to a wrench unit, comprising a drive unit and a ratchet unit which in the assembled condition are releasably and rigidly connected with each other, the drive unit includes a first drive coupling element, and the ratchet unit includes a ratchet, characterized in that and a second drive coupling element which is in driving engagement with the ratchet and, in the assembled condition of drive unit and ratchet unit, also with the first drive coupling element for driving the ratchet, wherein the drive unit (2) includes at least one latch (7) which is movable from an unlocking position, in which the drive unit (2) and the ratchet unit (3) are releasable from each other, into a locking position in which the drive unit (2) and the ratchet unit (3) in the assembled condition are rigidly connected with each other, and back, and at least one actuating element (9) with which the at least one latch (7) is movable from the one into the other position, and the ratchet unit (3) includes a latch receptacle (23) which is in locking engagement with the latch (7) in its locking position for rigidly connecting the drive unit (2) with the ratchet unit (3) in their assembled condition, wherein the drive unit (2) includes a second boundary surface (14) and the ratchet unit (3) includes a base surface (21) in its seat (19) for the drive unit (2), which both extend along the output direction and rest against each other in the assembled condition of drive unit (2) and ratchet unit (3), and wherein the drive unit (2) includes a supporting wedge (15) on its second boundary surface (14), which extends along the output direction and whose wedge angle ($\alpha$) opens to the rear vertically to the second boundary surface (14) against the output direction, and wherein the ratchet unit (3) includes a corresponding depression (24) for accommodating the supporting wedge (15) in its seat base surface (21), and wherein the supporting wedge (15) includes a supporting surface on its back (16) and the depression (24) includes an abutment surface at its rear end, against which the supporting surface (16) of the supporting wedge (15) rests in the assembled condition of drive unit (2) and ratchet unit (3).

2. The torque wrench system according to claim 1, wherein the drive unit (2) includes a front boundary surface (6) in an output direction and the ratchet unit (3) includes a seat (19) for accommodating the drive unit (2), which includes an end face (20) against which the drive unit (2) rests with its front boundary surface (6) in the assembled condition of drive unit (2) and ratchet unit (3), and that in the locking position the at least one latch (7) protrudes from the front boundary surface (6) of the drive unit (2) and the latch receptacle (23) is a depression in the seat end face (20) of the ratchet unit (3).

3. The torque wrench system according to claim 2, wherein the at least one latch (7) is retractable in the unlocking position to such an extent that it maximally extends up to the front boundary surface (6) of the drive unit (2).

4. The torque wrench system according to claim 1, wherein each latch (7) is spring-biased into its locking position and is movable from the locking position into its unlocking position by means of the latch actuating element (9) against the spring bias.

5. The torque wrench system according to claim 1, wherein the first drive coupling element (5) protrudes from the front boundary surface (6) of the drive unit (2) and can be brought into driving engagement with the second drive coupling element through an opening (22) in the seat end face (20) of the ratchet unit (3).

6. The torque wrench system according to claim 5, wherein on both sides of the first drive coupling element (5) a latch (7) each is arranged, and on both sides of the second drive coupling element associated latch receptacles (23) each are arranged.

7. The torque wrench system according to claim 1, at least one protrusion (17) extending to the rear protrudes from the supporting surface (16) of the supporting wedge (15) and in the abutment surface of the depression (24) a recess is formed, which in the assembled condition of drive unit (2) and ratchet unit (3) accommodates the at least one protrusion (17) of the supporting wedge (15), wherein the outer wall of the protrusion (17) rests against the inner wall of the recess.

* * * * *